United States Patent [19]

Zinn

[11] 4,288,687

[45] Sep. 8, 1981

[54] MULTIPOINT DIGITAL TACHOGRAPH

[75] Inventor: Michael J. Zinn, Noblesville, Ind.

[73] Assignee: Wallace Murray Corporation, New York, N.Y.

[21] Appl. No.: 67,171

[22] Filed: Aug. 16, 1979

[51] Int. Cl.[3] ..... G07C 1/04

[52] U.S. Cl. ..... 235/92 T; 235/92 CA

[58] Field of Search ..... 235/92 FQ, 92 T, 92 TF, 235/92 AE, 92 CA; 73/116; 324/160, 161, 166

[56] References Cited

U.S. PATENT DOCUMENTS 3,275,808 9/1966 Knudsen ..... 235/92 T 3,686,484 8/1972 Ciemochowski ..... 235/92 FQ 3,955,070 5/1976 Suzuki et al. ..... 235/92 CA 4,041,281 8/1977 Gaudeul ..... 235/92 T

*Primary Examiner*—Joseph M. Thesz

*Attorney, Agent, or Firm*—Thomas J. Greer, Jr.

[57] ABSTRACT

A system for the measurement, storing, and subsequent display of the amount of time a rotary element dwells within a predetermined speed range. The system exhibits utility for the measurement of rotary speeds of the driving and of the driven rotary elements of a fluid coupled fan drive of the type commonly employed with diesel engines.

4 Claims, 2 Drawing Figures

START MEASUREMENT ENABLING INPUT SWITCH KEYED TO ENGINE START UP { IGNITION SWITCH, OIL PRESSURE SWITCH, ETC.

MULTIPOINT DIGITAL TACHOGRAPH

This invention relates to a system for measuring, storing and subsequently displaying the amount of time spent at or above multiple points of interest, at pre-programmed rotational speeds, of two or more rotary elements. The system is termed a tachograph system and exhibits particular utility in testing a clutch or fluid coupling fan drive of the type commonly used on diesel and other internal combustion engines.

Temperature sensing clutches or fluid fan drives are often employed to couple the usual radiator cooling fan to the engine of an automotive vehicle. In order to improve the efficiency of the engine, such a coupling between the engine and the radiator cooling fan is often controlled by the engine cooling requirements. The required cooling, and thus the desired relationship between the rotational speeds of the engine and the cooling fan is a function of the ambient temperature, the speed of the engine, the heat rejection rate of the engine, and the ram air cooling effect due to the forward speed of the vehicle. During high cooling requirements, it is desired that the cooling fan be fully coupled to the engine. On the other hand, during much of the operating cycle, the full action of the cooling fan to cool the radiator liquid may not be required and, in such case, the full coupling of the fan to the engine would represent wasted power, i.e., power which would be required to rotate the fan. Couplings have been extensively used to control the relationship between the engine and cooling fan speeds for some time and are accordingly of great interest to automotive engineers. Thus any device, technique, system or the like which will facilitate the testing of couplings of the temperature control type, are of great interest to those who design automotive power plants and any other power plant employing a cooling fan for a radiator.

In the testing and examination of a coupling used as a fan clutch, one characteristic that is of interest to engineers and designers is the profile of the degree of coupling exhibited during the typically complex operating cycle of the engine. It is thus helpful to be able to measure and record, for complex engine operating cycle in a variety of ambient conditions, the accumulated times at which the engine is operating above certain preselected rotational speeds and during the same cycle the accumulated times during which the fan operates above other pre-selected speeds. This enables one to infer the proportion of operating time during which a fan clutch results in power savings and noise reduction by allowing the fan to rotate at high speed only during times when cooling requirements necessitate it, rather than constantly, as in the case of a directly coupled fan.

According to the practice of this invention, the accumulated operating time above multiple preselected speeds of two or more relatively rotatable elements are measured, stored and subsequently displayed along with a total elapsed time which is stored and displayed. This device exhibits particular utility in determining the coupling profile of a fan clutch interfacing an engine and a cooling fan. However, such a device could be used in any application where it was desired to measure the relationship between two or more rotating elements.

IN THE DRAWINGS

Figure 1:
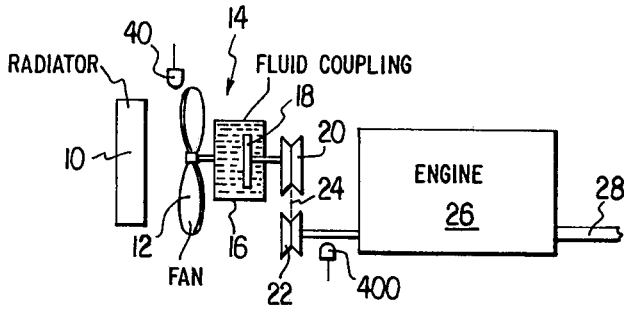
FIG. 1 is a schematic view illustrating a radiator, a radiator fan, a temperature controlled fluid coupling and a liquid cooled internal combustion engine.

Referring now to FIG. 1 of the drawings, a portion of a typical internal combustion engine in an automotive vehicle is illustrated, the numeral 10 denoting the usual radiator. The numeral 12 denotes a fan for drawing air in from the front of the vehicle, through the radiator and towards the engine. The numeral 14 denotes a coupling, such as a temperature controlled fluid coupling, and may be of any conventional construction. Typically, it includes a housing 16 filled with a viscous liquid and includes a recess for receiving a drive disc 18 driven by pulley 20. Pulley 20 is driven by pulley 22 by means of a belt indicated schematically by the numeral 24, the pulley 22 being directly driven through a shaft coupled to engine 26. The numeral 28 denotes the drive shaft of the engine extending towards the rear transmission unit, not illustrated. In operation, the drive disc 18 is turned by the engine, the drive disc transmitting its rotary force through the viscous fluid in housing 16, consequent rotation of the housing 16 being transmitted to the fan 12 which is directly coupled thereto. In the event that the coupling 14 is a temperature controlled coupling, a suitable temperature sensing element (not illustrated) varies the degree of fluid coupling between the drive disc 18 and the driven housing 16, to thereby effect a more even correspondence between the cooling requirements of the liquid passing through radiator 10 and the ambient temperature conditions. What has thus far been described is well known to workers in this art.

Figure 2:
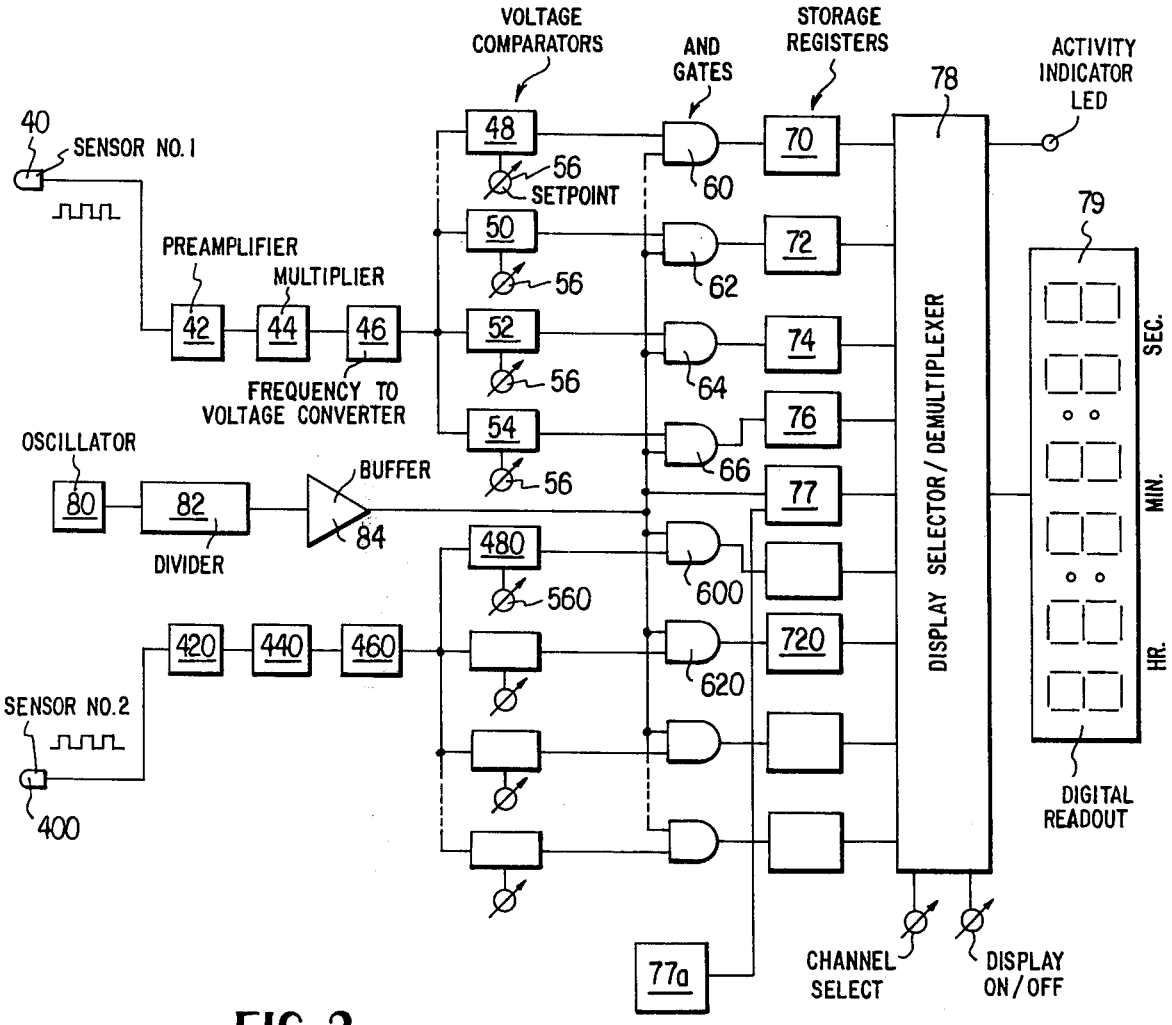
FIG. 2 is a schematic view illustrating the tachograph test system and apparatus according to the practice of this invention.

Referring now to FIG. 2 of the drawings, a schematic illustration of the system of this invention is shown. In general, the system includes two or more sensor sections which may be regarded as in parallel with each other, both sections leading into a display selector/-demultiplexer. Commencing now with a description of one of the two sensor sections, the numeral 40 designates a first sensor such as a photooptical or magnetic pickup sensor, which is associated with the fan 12. The sensor produces a pulse train proportional to sensed rotational speed. Similarly, the numeral 400 denotes a second and similar sensor which is associated with the engine 26, see FIG. 1. Sensor 40 senses the speed of rotation of fan 12, while sensor 400 senses the speed of rotation of engine 26 which is thus proportional to the speed of rotation of driving disc 18. These two sensors may be placed at any convenient location relative to the engine and its accessories.

The numeral 42 denotes a preamplifier which includes a Schmidt trigger and circuitry to square up the incoming signals and thus provide high noise immunity and high degree of insensitivity to the wave shape. The numeral 44 denotes a "phase locked loop" which multiplies the frequency by a constant factor. This frequency multiplication provides a higher frequency component signal to be processed, thereby shortening system time constants. The numeral 46 denotes a frequency to voltage converter which changes the incoming signal to a d.c. voltage proportional to its frequenty. Elements 42, 44 and 46 may be of any conventional construction and are themselves known. The output of element 46 is a voltage and this is fed to a series of voltage comparators 48, 50, 52 and 54. The reader will understand that while four such comparators are illustrated, any number may be employed. Each comparator is provided with a device 56 which determines its setpoint. The numerals 60, 62, 64 and 66 denote AND gates, one input of each being coupled to the output of its associated voltage comparator 48, 50, etc. The numerals 70, 72, 74 and 76 denote storage registers of conventional and well known construction. Each storage register is associated with a corresponding AND gate, as illustrated.

Referring now to the lowerportion of FIG. 2, the reader will observe that the lowermost system section is identical with the uppermost, and is coupled in an entirely similar manner to its sensor 400. Thus, the preamplifier 42 previously descrihed finds its counterpart in the second sensor section of FIG. 2 in preamplifier 420. Similarly, multiplier 44 previously described finds it counterpart in element 440. Thus, the suffix zero is added to the elements which make up the second half of the system.

The numeral 80 denotes an oscillator of conventional construction, such as one megahertz crystal oscillator, which output is coupled to frequency divider 82, which divides, typically, by a factor of one million and the output of which (one cycle per second for the typical parameters given) is in turn coupled to a buffer 84. The buffer is a post amplifier capable of driving a large number of gates.

The output of the buffer is fed to a line common to one input of the AND gates 60, 600, etc. The output of these storage registers 70, 700, etc. is fed to a display selector/demultiplexer 78 of conventional construction. The output of this element is fed, in turn, to a digital readout denoted by the numeral 79.

The operation of the system illustrated at FIG. 2 is as follows. With the engine 26 of FIG. 1 turning, first sensor 40 will measure the speed of rotation of fan 12, while second sensor 400 will measure the speed of rotation of engine 26. As indicated by the lead lines from sensors 40 and 400, the output from these sensors is a potential having pulsed wave shape. This output of sensor 40 is fed to preamplifier 42 for amplification and squaring, after which it is multiplied by element 44. This output is then fed to element 46 where the frequency of the square wave is converted into a potential whose magnitude is proportional to the frequency. This potential, thus dependent upon frequency sensed by sensor 40, is fed to the inputs of voltage comparators 48, 50, etc. Typically, the comparators are set, by their respective setpoints, for successively higher voltages which represent frequency or RPM points of interest. That is to say, there will be an output from the first comparator 48 if the input from buffer element 46 is at least as great or greater than the setpoint for comparator 48, the latter determined by the setting of setpoint element 56. Similarly, voltage comparator 50 and its associated setpoint element 56 will pass a voltage higher than that passed by comparator 48. This is because the setpoints determined by elements 56 are set successively higher for the comparators 48, 50, etc. However, they may be independently and randomly set as required by application.

The oscillator 80 and frequency divider 82 function as a clock whose purpose is to produce periodic pulses which are then fed to one input of each of the AND gates 60, 600, etc. The other input to these gates is, as just described, defined by the output of the voltage comparators 48, 50, etc.

Thus, once each second (with the parameters given) one input to each of the AND gates is pulsed by buffer 84 and if there is a corresponding signal on the other input of a particular AND gate from an associated voltage comparator, then that particular gate will pass a signal to its associate storage register 70, 700, etc. The storage registers thus each record the time that its associated AND gate 60, 62, etc. conducts. This time, in turn, will depend upon the amount of time there has been an output on the associated comparators 48, 50, etc. One storage register 77 stores total time instrument in operation. The total time factor is important because the ratio of total time to time at a setpoint may be used to define various engineering parameters of percentage on time, etc., i.e., a time histogram recorded digitally. In addition, register 77 acts as an enabling input, coupled to a switch 77*a*, i.e. an ignition switch or oil pressure switch, so that such histograms are representative of actual operating time.

The operation of elements 400, 420, 440, etc. for the lower half of the circuit shown in FIG. 2 is identical with that described.

The display selector/demultiplexer 78 receives the outputs of storage registers 70, 700, etc. and displays them on digital readouts elements 79.

The reader will now be in a position to comprehend that by selecting the desired channels from the channel selector on element 78, the operation time above any selected speed for either the engine or for the fan may be digitally displayed on element 79. Typically, engine 26 is operated in a normally complex cycle under a variety of speeds, loads and ambient conditions. Data retrieval, such as operation times within each speed range may be recalled for display by addressing the storage register of interest using the display/multiplexer 78 which routes the totalized time data in the storage register to the total display 79. The display 79 may be disabled to save battery power. The activity indicator, a light emitting diode (LED), provides visual indication that the system instrumentation is in operation even though the display is off. While two sensors 40 and 400 are shown and described any number of sensors, each with its own set of comparators, AND gates, and storage registers, may be employed. Each sensor may thus be associated with a channel.

U.S. Pat. No. 3,581,561 issued to Tomashek et al discloses a measurement system having portions which are similar to that herein described. In that system, a magnetic pickup senses the speed of rotation of an engine ring gear, and this speed is converted to a voltage from whence it is fed to a voltage comparator device. The voltage comparator device then acts either to open or to close a gate, with opening of the gate actuating a counter. However, that system neither shows nor suggests the equivalent of the storage registers, the display selector/demultiplexer or the digital readout of this invention. Further, there is no indication that the system could be used as a comparator, as is this sytem, i.e., it does not produce a digital time histogram.

The prior art is also aware of U.S. Pat. No. 3,651,690 issued to Pagdin et al which discloses, again, a magnetic pickup to measure pulses from a rotating part. However, there is no showing of a pulse to voltage converter or suggestions that the system might be employed as this sytem.

While the drawings and description have described the invention as useful with respect to two rotational elements, it will be noted that the invention exhibits utility with a greater number of rotational elements.

What is claimed is:

1. A multipoint digital tachograph system for measuring, storing, and displaying the amount of total time as well as time spent at or above multiple points of interest, such as at pre-programmed rotational speeds of two rotary elements, the rotary elements rotating at different but related speeds, the system including a channel for each rotary element, each channel including, (a) a sensor for sensing and converting to pulses the rotational speed of a rotary element, (b) means for converting the pulses to a voltage, to thereby obtain a voltage proportional to rotary speed, (c) a plurality of voltage comparators each coupled to receive said rotary speed voltage, each comparator passing a signal only after a predetermined reference voltage associated with it has been fed to it, (d) a plurality of AND gates each having means for energizing one input terminal thereof and having its other terminal coupled to an associated one of said voltage comparators, whereby each AND gate opens and passes a signal to its output terminal only when and after its associated voltage comparator passes a signal responsive to equality between the predetermined reference voltage and the said rotary speed voltage, (e) a plurality of storage registers each coupled to a respective one of said AND gates, each register storing the time its associated AND gate passes a signal from the latter's output, (f) means for selectively reading and for displaying the information in a selected one of the storage registers, (g) whereby the operation time of each rotary element, at or above a desired rotary speed as well as the total time of operation, may be displayed for inspection.

2. The tachograph system of claim 1 wherein said means for energizing one terminal of each of said AND gates is a master clock which transmits periodic pulses.

3. The system of claim 1 wherein said means for selectively reading and for displaying is a display selector/-demultiplexer and digital read out coupled thereto.

4. The system of any of claims 1, 2 or 3 including means to multiply the frequency of the pulses of said sensor by a constant factor, whereby a higher frequency component signal to be processed is provided, thereby shortening time constants of the system.

* * * * *